United States Patent [19]

Fang et al.

[11] Patent Number: 5,008,158

[45] Date of Patent: Apr. 16, 1991

[54] PRODUCTION OF METAL MATRIX COMPOSITES REINFORCED WITH POLYMER FIBERS

[75] Inventors: Que-Tsang Fang, Murrysville; Caroline Wei-Berk, Monroeville, both of Pa.

[73] Assignee: Aluminum Company of America, Pittsburgh, Pa.

[21] Appl. No.: 267,844

[22] Filed: Nov. 7, 1988

[51] Int. Cl.[5] ..... C22C 1/09

[52] U.S. Cl. ..... 428/614

[58] Field of Search ..... 428/614

[56] References Cited

U.S. PATENT DOCUMENTS 3,652,236 3/1972 Odekerken ..... 428/667
4,533,685 8/1985 Hudgin et al. ..... 252/512

FOREIGN PATENT DOCUMENTS 61-124679 6/1986 Japan .
63-175813 7/1988 Japan .
1499383 2/1978 United Kingdom ..... 428/614

OTHER PUBLICATIONS

Seifert et al., "Fiber composite materials of metals and polymers," Z. Metallkd., 72(12), pp. 854–864, 1981.

*Primary Examiner*—Theodore Morris
*Assistant Examiner*—David W. Schumaker
*Attorney, Agent, or Firm*—David W. Pearce-Smith

[57] ABSTRACT

Disclosed is a metal matrix composite comprising randomly oriented polymer fibers and a metal alloy surrounding the polymer fiber. The composite is formed by the method of manufacturing comprising the steps of: (1) providing polymer fibers; (2) providing a liquid-phase metal; (3) mixing the liquid-phase metal and the polymer fibers; and (4) allowing the liquid-phase metal to solidify and form a metal matrix composite. In a preferred embodiment, the polymer fibers are liquid crystal polymer fibers.

16 Claims, 2 Drawing Sheets

Trans. 50X

Long. 200 μm 50X

PRODUCTION OF METAL MATRIX COMPOSITES REINFORCED WITH POLYMER FIBERS

TECHNICAL FIELD

This invention relates to the manufacture of high temperature polymer fiber reinforced metal matrix composites. More particularly, the invention relates to liquid-phase fabrication methods for the production of metal matrix composites reinforced with high thermal stability polymer fibers.

BACKGROUND ART

A composite is a material in which two or more constituents are combined to result in a material which has properties different from either component. Typical composites are from materials in which one of the components has very high strength and modulus and the other has high ductility. Their properties generally follow the rule of mixtures. For example, if elastic modulus is the property of interest, the elastic modulus of the composite is approximately the weighted sum of the elastic modulus of the constituents.

Metal matrix composites provide a relatively new way of strengthening metals. Liquid-phase fabrication methods are particularly suited for the production of metal matrix composite parts using fibers. Uniform fiber distributions of the fibers can generally be achieved with little porosity in the matrix. However, the contact of liquid-phase metal with fibers often induces interfacial reactions.

The term "liquid-phase metal" is used herein to describe all fluid and semi-fluid phases in which the metal was not completely solidified. The term includes metal slurry and semi-solid phases.

Metal matrix composites are reinforced with either ceramic or graphite fibers. Ceramic or graphite fibers are used because it has always been thought that they are most suited to withstand the processing temperatures needed to bring the metal component to its molten or liquid phase without degradation of the fiber.

Fiber surface coatings are applied to the surface of the ceramic and graphite fibers with the aim of modifying the fiber surface characteristic so as to prevent deterioration in fiber stiffness and strength at elevated fabrication temperatures and to enhance the fiber/matrix wettability and adhesion. Fiber/matrix wettability and adhesion is extremely important since good bonding between the fiber and matrix is crucial to obtaining the maximum final strength of the metal matrix composite. However, known surface coatings and treatments for ceramic and graphite fibers are expensive and have not proven to be reliable. In addition, the ceramic or graphite fibers used are brittle and are sensitive to handling. This has further increased the cost of fabricating a metal matrix composite.

There exists a need for a metal matrix composite that is formed from a fiber that does not require surface coatings to withstand the high temperatures associated with liquid-phase metal fabrication methods. Heretofore, polymer fibers have not been used in metal matrix composites because of thermal degradation of the polymers.

The principal object of the present invention is to provide a liquid-phase fabrication method and metal matrix composite which does not suffer from the limitations of prior metal matrix composites.

Another object of the present invention is to provide a liquid-phase fabrication method and metal matrix composite which utilizes polymer fibers and relatively short processing times which will not cause the polymer fibers to degrade.

Still another object of the present invention is to provide a liquid-phase fabrication method and metal matrix composite which does not require surface treatment or coating of the fibers prior to liquid-phase fabrication of the composite to increase the fiber/matrix wettability and adhesion and/or to reduce brittle compound reactions between fibers and metal.

Yet another object of the present invention is to provide a liquid-phase fabrication method and metal matrix composite which has a low void fraction.

A further object of the present invention is to provide a metal matrix composite that is light in weight.

Additional objects and advantages of the invention will be more fully understood and appreciated with reference to the following description.

DISCLOSURE OF THE INVENTION

In accordance with the present invention, a method for manufacturing a metal matrix composite material is provided which comprises the steps of: (1) providing high thermal stability polymer fibers; (2) providing a liquid-phase metal; (3) infiltrating the liquid-phase metal through the high thermal stability fibers; and (4) allowing the liquid-phase metal to solidify and form a metal matrix composite.

The material of the present invention comprises: (1) high thermal stability fibers; and (2) an alloy having a melting temperature of less than 600° C. In a preferred embodiment of the present invention, the high thermal stability fibers are "KEVLAR" liquid crystal fibers. The fibers and the alloy are processed at a temperature of about 580° C. The fibers may be randomly oriented, unidirectional or woven. The fibers used in the present invention do not need to be coated or pretreated to be wet by the liquid-phase metal.

BRIEF DESCRIPTION OF THE DRAWINGS

Other features of the present invention will be further described or rendered obvious in the following related description of the preferred embodiment which is to be considered together with the accompanying drawings wherein like figures refer to like parts and further wherein.

MODE FOR CARRYING OUT THE INVENTION

Figure 1:
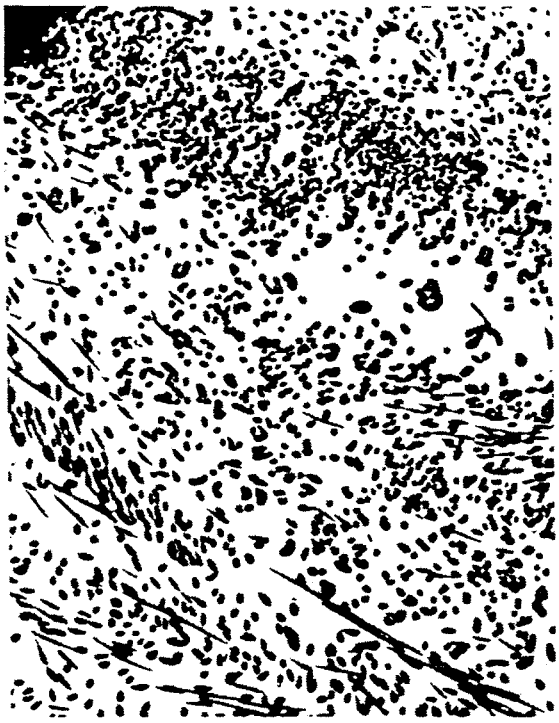
FIG. 1 is a photograph of the transverse cross-sectional microstructure of the as-cast composite of the present invention at 50X magnification.
Figure 2:
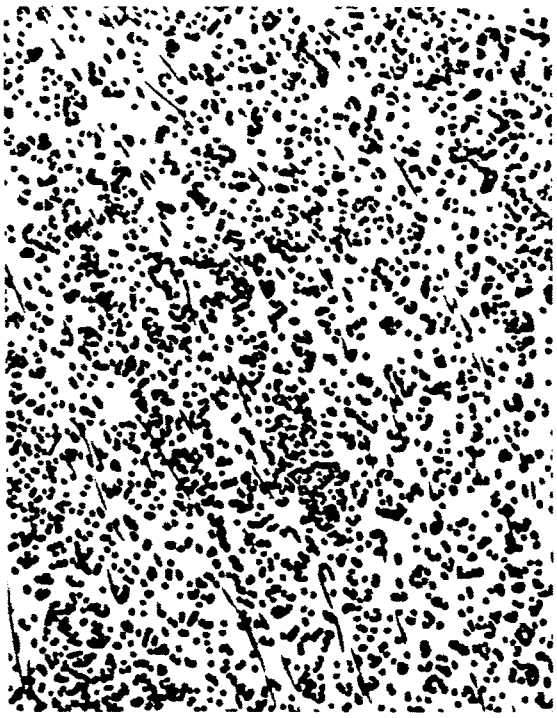
FIG. 2 is a photograph of the longitudinal cross-sectional microstructure of the as-cast composite of the present invention at 50X magnification.
Figure 3:
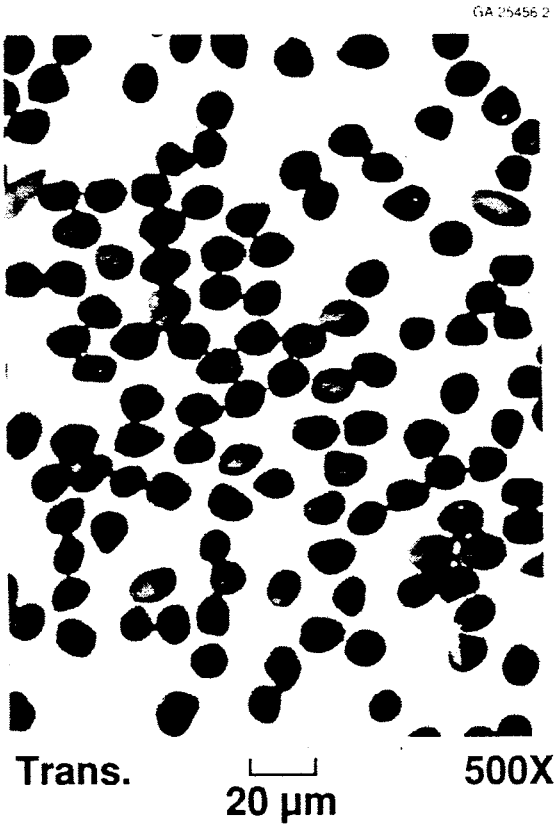
FIG. 3 is a photograph of the microstructure of the as-cast composite of the present invention at 500X magnification.
Figure 4:
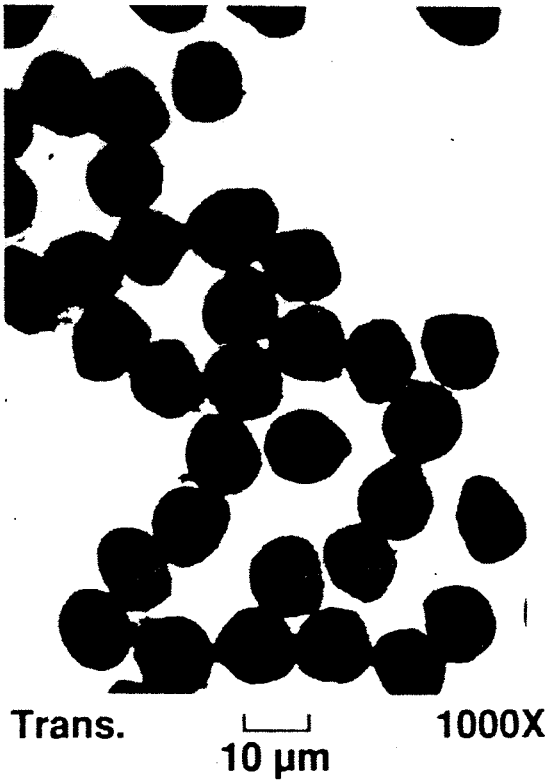
FIG. 4 is a photograph of the microstructure of the as-cast composite of the present invention at 1000X magnification.

An example of the metal matrix composite formed by the method of the present invention is shown in FIGS. 1–4. FIG. 1 is a photograph of the cross section of as-cast metal matrix composite material at 50X magnification. The material is generally referred to by the numeral 10 and comprises non-woven, randomly oriented high thermal stability polymer fibers 20 in a metal matrix 30.

Fibers 20 are randomly oriented throughout the metal matrix. This is evident by similarity of FIGS. 1 and 2 which are photographs of transverse and longitudinal sections of material, respectively. The fibers are less than two inches in length, and preferably less than one inch in length. The cross-sectional thickness of the fibers is approximately 10 microns.

Favorable results may be obtained if the fibers 20 are made of liquid crystal polymer material. The liquid crystal polymer material may be selected- from the group of synthetic fibers including "KEVLAR," "NOMEX," "XYDAR" polybenzobisthiazole, polybenzobisimidazole, and polybenzobisoxazole. "KEVLAR" and "NOMEX" are registered trademarks of Du Pont. "KEVLAR" is a high-strength, low-density synthetic aramid fiber formed from poly-p-phenyleneterephthalamid(PPD-T). "NOMEX" is a registered trademark for a poly(metaphenylene isophthalamide). "XYDAR" is a registered trademark of Dartco. "XYDAR" is a registered trademark for a liquid crystal polymer derived from p-hydroxybenzoic acid, terephthalic acid and 4,4'-dihydroxydiphenyl. "VECTRA" is a registered trademark for a liquid crystal polymer derived from p-hydroxybenzoic acid and 6-hydroxy—2—naphthoic acid monomers. "VECTRA" is sold by Celanese, a division of Hoechst. Other high thermal materials that may be used to form fibers include, but are not limited to, polyamide, polyamide-imides, polyester-imides, polysiloxanes and copolymers, polysiloxane-carborane, polyphosphazenes, polyquinoxalines, PEEK (poly ether ether ketone) and polyether sulfone. The critical feature of these fibers is their ability to withstand high temperatures for short periods of time without significant thermal degradation.

Metal matrix 30 is a relatively low temperature alloy. Favorable results may be obtained if the alloy has a melting temperature of up to approximately 600° C. It is the melting point of the metal and not its chemical composition which is critical to practicing the present invention. The preferred metal alloys are zinc-aluminum alloys containing 15–25% aluminum and 0.5–2.0% copper.

Heretofore polymer fibers were never considered suitable as a metal matrix reinforcement material. Polymer fibers have a degradation temperature substantially below the melting point or most engineering alloys. Surprisingly, if the processing technique requires only a brief exposure, less than a few minutes, high thermal stability polymer fibers can be used to reinforce metal matrix composites formed by liquid-phase metal fabrication methods without degradation of the fibers. Liquid crystal fibers and other high thermal stability polymer fibers can be used because they are much more heat resistant than industrial-grade polymer fibers such as nylon or polyester.

Surprisingly, the high thermal stability polymer fibers need not have a melting point or a softening point above the melting point of the metal matrix in which it is to be used. Softening temperatures and melting temperatures are determined by slowly heating the polymer at a rate of about 10° C per minute. The method of the present invention exposes the fiber to much greater changes in temperature for much shorter periods of time than are used in determining softening and melting temperatures. Thus, the high thermal stability polymer fibers can be used with metal matrix alloy having a melting point well above the softening point of the fibers.

The procedure for making the metal matrix composite shown in FIGS. 1–4 is as follows. First, "KEVLAR" fibers having a cross-sectional diameter of approximately 10 microns were formed into a preform having a shape similar to the desired metal matrix composite component. The fibers were randomly placed within the preform so that the resulting composite would be reinforced in all directions.

The preform was then placed inside a mold connected to a vacuum chamber and preheated to a temperature of approximately 400° C. A vacuum was pulled to bring the pressure in the chamber to $10^{-3}$ torr. The purpose of the vacuum is twofold; first, to prevent oxidation of the fibers and metal during processing, and second, to create and/or add to a pressure differential which increases the rate of casting and decreases the length of time that the fibers need to be exposed to higher temperatures.

A zinc alloy having 21% aluminum and 1% copper was preheated to 585° C. to bring it to a liquid phase. The furnace was then turned off and the molten zinc alloy was infiltrated through the preform by pneumatic means under 800 psi.

After cooling, the composite was cut into sections and photomicrographs were taken in directions which were transverse and longitudinal to the direction of liquid metal flow. FIGS. 1–4 are the microphotographs of the as-cast material. These photomicrographs clearly indicate that the liquid metal penetrated between and wet the fibers without any observable degradation of the fibers between the fibers and the metal. The fiber-metal interface indicates good wettability, bond strength and an absence of brittle phase formation.

The metal matrix composite formed according to the invention may be applied with particular advantage as (1) engineering components such as bearings because of reduced friction associated with the polymer fibers, and (2) structural components in a vehicle such as an automobile or in a space vehicle or aircraft in order to obtain a saving on weight of construction. It is believed that metal matrix composites fabricated in accordance with the present invention will have higher tensile strengths and yield modulus than the metal matrix alloy.

It is to be appreciated that certain features of the present invention may be changed without departing from the present invention. Thus, for example, the dimensions of the fiber used may vary. The fibers may be chopped into 0.125 inch segments or may be one continuous segment. Additionally, the cross-sectional diameter of the fibers is not critical and may be other than 10 microns. It is contemplated that fibers having a cross-sectional diameter between 2 and 50 microns may be used in practicing the present invention. If fiber having a cross-sectional diameter below 2 microns becomes commercially available, it is contemplated that they can be used in practicing the present invention. It is also contemplated that more than one size fiber may be used.

It is also to be appreciated that although the fibers used were randomly oriented, they may be unidirectional or woven. Additionally, the fibers may be used as a much larger volume percentage of the composite than shown in FIGS. 1–4. Thus, for example, the volume percent of the fibers may be increased to a point where there is only just enough metal to form a matrix around the individual fibers. The volume percent of fibers used may be decreased to a point where the fibers represent an incidental impurity in the resulting composite. It is envisioned that a metal matrix composite containing 10 to 60 volume percent fiber will result in a composite containing useful properties that are different from its constituents.

It is also contemplated that other times and temperatures may be used in forming the cast metal matrix composite. Thus, for example, if a higher temperature alloy is used, the period that the fiber is exposed to the higher temperature may need to be accordingly reduced to avoid degradation of the fiber.

In addition, the molten matrix material may be infiltrated into the reinforcing material by other liquid-phase fabrication methods known to the art. Thus, for example, infiltration may be carried out under gravity and inert gas pressure with vibrators used to reduce the number of voids in the cast material. It is to be appreciated that although the invention was described in terms of infiltrating the metal into a preform under pressure, other techniques may be used. Thus, the metal and polymer fibers may be premixed and quickly cast into the desired piece. In addition, casting may be carried out by squeeze casting, rheocasting, compocasting or under vacuum without the use of positive pressure. The casting may be carried out using mechanical, hydraulic, vacuum and/or high pressure means.

Furthermore, the metal used need not be a zinc-aluminum alloy. Other metal alloys that may be used are those with melting points below about 700° C.

These and other changes of the type described could be made to the present invention without departing from the spirit of the invention. The scope of the present invention is indicated by the broad general meaning of the terms in which the claims are expressed.

What is claimed is:

1. A metal matrix composite comprising:
non-woven liquid crystal polymer fibers; and
a metal alloy matrix surrounding said fibers, said metal alloy matrix having been formed by infiltrating a liquid phase of said metal into a preform of said fibers having no coating or surface treatment.

2. The composite of claim 1 which further includes:
said fibers are woven or unidirectionally oriented.

3. A metal matrix composite comprising:
polymer fiber having lengths of less than two inches; and
a metal alloy matrix surrounding said polymer fiber.

4. The composite of claim 3 which further includes:
said polymer fibers having lengths from about 0.02 to 0.8 inch.

5. The composite of claim 3 which further includes:
said metal forming a matrix using a liquid phase fabrication method without compacting said polymer fibers in a pressure mold.

6. The composite of claim 5 which further includes:
said metal forming a matrix without coating said polymer fibers prior to said liquid phase fabrication.

7. The composite of claim 3 which further includes:
said polymer fibers including polymer fibers selected from the group of synthetic fibers consisting of "KEVLAR", "XYDAR", "NOMEX", "VECTRA", polybenzobisthiazole, polybenzobisimidazole, polybenzobisoxazole, polyamide, aromatic polyamide, polyamide-imides, polyesterimides, polysiloxanes and copolymers, polysiloxane-carborane, polyphosphazenes, polyquinoxalines, polyetherether ketones, and polyether sulfones.

8. A metal matrix composite comprising:
polymer fiber; and
a metal alloy matrix containing 15 to 25% aluminum and 0.5 to 2.0% copper surrounding said polymer fiber.

9. The composite of claim 8 which further includes:
said polymer fibers including polymer fibers selected from the group of synthetic fibers consisting of "KEVLAR", "XYDAR", "NOMEX", "VECTRA", polybenzobisthiazole, polybenzobisimidazole, polybenzobisoxazole, polyamide, aromatic polyamide, polyamide-imides, polyesterimides, polysiloxanes and copolymers, polysiloxane-carborane, polyphosphazenes, polyquinoxalines, polyetherether ketones, and polyether sulfones.

10. A metal matrix composite comprising:
randomly orientated polymer fibers; and
a metal alloy surrounding said polymer fiber.

11. The composite of claim 10 which further includes:
said polymer fibers including polymer fibers selected from the group of synthetic fibers consisting of "KEVLAR", "XYDAR", "NOMEX", "VECTRA", polybenzobisthiazole, polybenzobisimidazole, polybenzobisoxazole, polyamide, aromatic polyamide, polyamide-imides, polyesterimides, polysiloxanes and copolymers, polysiloxane-carborane, polyphosphazenes, polyquinoxalines, polyetherether ketones, and polyether sulfones.

12. The composite of claim 10 which further includes:
said metal alloy matrix having a melting temperature of less than 700° C.

13. A fiber reinforced composite comprising:
uncoated non-woven liquid crystal polymer fibers; and
a metal matrix which surrounds said fibers, said metal matrix being the resulting composite having been formed by infiltrating the liquid phase of said metal into a preform of said uncoated polymer fibers.

14. The composite of claim 13 which further includes:
said metal matrix having a melting temperature of less than 700° C.

15. A fiber reinforced composite comprising:
uncoated polymer fibers formed from liquid crystal polymers; and
a metal matrix which surrounds said fibers, said metal matrix having been formed by infiltrating the liquid phase of said metal into a preform of said uncoated polymer fibers.

16. The composite of claim 15 which further includes:
said polymer fibers including polymer fibers selected from the group of synthetic fibers consisting of "KEVLAR", "XYDAR", "NOMEX", "VECTRA", polybenzobisthiazole, polybenzobisimidazole, polybenzobisoxazole, polyamide, aromatic polyamide, polyamide-imides, polyesterimides, polysiloxanes and copolymers, polysiloxane-carborane, polyphosphazenes, polyquinoxalines, polyetherether ketones, and polyether sulfones.

* * * * *